United States Patent [19]

Hamm

[11] 4,406,633

[45] Sep. 27, 1983

[54] POWER TAKE-OFF GEARING FOR ASSEMBLY AT A MARINE VESSEL DRIVE OR PROPULSION SYSTEM

[75] Inventor: Robert Hamm, Nürensdorf, Switzerland

[73] Assignee: Maag Gear-Wheel & Machine Company Limited, Zurich, Switzerland

[21] Appl. No.: 260,335

[22] Filed: May 4, 1981

[30] Foreign Application Priority Data

May 23, 1980 [CH] Switzerland ..... 4050/80

[51] Int. Cl.[3] ..... B63H 23/06

[52] U.S. Cl. ..... 440/75; 440/83; 440/86; 192/67 R; 74/15.88

[58] Field of Search ..... 114/3, 4, 75, 83, 85; 180/53 B, 53 D; 212/172; 74/15.63, 15.8, 15.84, 332, 333, 342, 344, 15.88, 665 F, 665 G, 665 GA; 192/67 R

[56] References Cited

U.S. PATENT DOCUMENTS

| | | | |
|---|---|---|---|
| 1,258,883 | 3/1918 | Farmer | 74/15.88 |
| 1,858,700 | 5/1932 | Besonson | 74/15.88 |
| 4,188, 838 | 2/1980 | Nakao et al. | 74/665 T |

FOREIGN PATENT DOCUMENTS 2501675 2/1979 Fed. Rep. of Germany .

OTHER PUBLICATIONS

Renk Tecknik Information 15, Germany.
LuS Mitteilungen 72 I/78.

*Primary Examiner*—Trygve M. Blix
*Assistant Examiner*—Stephen P. Avila
*Attorney, Agent, or Firm*—Werner W. Kleeman

[57] ABSTRACT

With this power take-off gearing, intended to be installed at a propulsion system or drive of a marine vessel, there can be taken-off part of the vessel's drive output at one or a number of auxiliary drive units. The drive or propulsion system of the vessel is mounted upon the ship's foundation and essentially comprises a main engine, a speed reduction gear unit containing a power take-off shaft, a multi-part propeller shaft which extends through a power take-off gearing, and a propeller attached to the propeller shaft. The power take-off gearing is arranged in a housing and supported as a self-contained unit upon the ship's foundation independent of the propeller shaft. A large gear mounted in the housing of the power take-off gearing is driven by the propeller shaft through a moveable clutch which is constructed as a double tooth clutch. The power take-off gearing is connected with a generator.

6 Claims, 2 Drawing Figures

POWER TAKE-OFF GEARING FOR ASSEMBLY AT A MARINE VESSEL DRIVE OR PROPULSION SYSTEM

BACKGROUND OF INVENTION

The present invention relates to a new and improved construction of a power take-off gearing or gear unit intended to be installed at a drive or propulsion system of a marine vessel.

Generally speaking, with the arrangement of the invention a propeller shaft is flanged to the power take-off shaft of a main engine or gearing and there is arranged coaxially to the propeller shaft, within a housing, a large gear of the power take-off gearing or gear unit which is driven by the propeller shaft. The housing is supported as a self-contained unit at the ship's foundation.

Such power take-off gearing or gear units, also referred to in the art as PTO-gearing, are used with vessels for the purpose of driving auxiliary current generators for pumps, lifting devices and other equipment. For such fields of application there are required drive capacities or outputs, in the order of 250 to 2500 kW, corresponding to approximately one-tenth of the main engine output. Since pumps, lifting devices and so forth also must be capable of being operated when the vessel is in the harbor, there are operatively associated with the auxiliary current generators separate engines, generally high-speed diesel engines. When the vessel or ship is at sea it is however more economical to drive all of the generators from the ship's engine, which generally is a slow-running diesel engine, which in contrast to the high-speed engines can be operated with comparatively less expensive bunker fuel, and additionally, has a lower specific fuel consumption, usually also develops less noise.

Because of these advantages not only are new ship constructions equipped with such power take-off gear units, but also older ship constructions are increasingly equipped with the same. The retrofitting of existing power take-off gearing requires, however, expensive modifications of parts of the existing propulsion system or drive of the vessel or ship.

Thus, for instance from the publications LuS-Mitteilungen 72 I/78 and Renk Technik Information 15, there have become known in this technology power take-off gearing or gear units of the previously described type, wherein the large gear of the power take-off gear unit is relatively fixedly secured to a shaft portion of the propeller shaft. This shaft portion or piece is flanged, for instance bolted, to the power take-off shaft of the main engine or gearing. The housing of the power take-off gearing is mounted at both ends of the large gear arranged therein upon the shaft portion of the propeller shaft and is moveably supported at the ship's foundation in such a manner that the entire power take-off gearing can perform radial movements, especially can follow bending vibrations of the shaft portion of the propeller shaft which is enclosed by the power take-off gearing. This design presupposes that the shaft portion of the propeller shaft, which is enclosed by the housing of the power take-off gearing, is especially constructed for the attachment of the large gear and for the mounting of the housing of the power take-off gearing. In order to retrofit a power take-off gear unit it is therefore necessary to exchange a shaft portion or piece of the propeller shaft or at least to provide such with attachment surfaces for the large gear as well as with bearing surfaces for the housing of the power take-off gearing or gear unit. These operations cannot be carried out on-board a ship. During operation of the heretofore known constructions of power take-off gear units difficulties can arise by virtue of the fact that the quite considerable sluggish mass of the power take-off gearing can be placed into movement by bending vibrations of the shaft portion of the propeller shaft which is enclosed by the power take-off gearing. Consequently, there are produced appreciable mass inertia forces which, on the one hand, intensively load the propeller shaft as well as its bearing and, on the other hand, the bearings with which the power take-off gearing is mounted upon the propeller shaft.

In German Pat. No. 2,501,675 there is also disclosed a marine vessel gearing or gear unit wherein a speed reduction gearing and a power take-off gearing arranged between the speed reduction gearing and the ship's engine form a structural unit. The power take-off gearing is provided with a housing which is directly mounted at the housing of the speed reduction gearing. Mounted within the housing of the power take-off gearing is a hollow hub of a large gear through which piercingly extends a torsion shaft which interconnects the ship's engine with the speed reduction gearing. The large gear of the power take-off gearing is connected by a double tooth clutch with a flange formed at the torsion shaft. A clutch or coupling sleeve constituting part of the double tooth clutch in turn encloses with radial play the torsion shaft, and also extends with radial play through the hollow hub of the large gear of the power take-off gearing. This clutch or coupling sleeve is provided at both ends with a respective ring of external teeth. One of both rings of these external teeth, i.e. the external gears, engages with a ring of internal teeth or an internal gear which is formed at a first clutch ring which is bolted to the aforementioned flange of the torsion shaft. The other external teeth of the clutch sleeve engages with an internal ring of teeth of a second clutch ring which is bolted with the hub of the large gear of the power take-off gearing at its side facing away from the first clutch ring. This state-of-the-art arrangement of a power take-off gearing between a ship's engine and the related speed reduction gearing is only suitable for use in those situations where the speed reduction gearing and the power take-off gearing form a self-contained unit right from the start; retrofitting of the power take-off gearing at an existing propulsion system or drive of a ship cannot be carried out without disassembly and modification of the speed reduction gearing.

SUMMARY OF THE INVENTION

Therefore, with the foregoing in mind it is a primary object of the present invention to provide a new and improved construction of power take-off gearing for a marine vessel drive or propulsion system which is not associated with the aforementioned drawbacks and limitations of the prior art constructions heretofore discussed.

Another and more specific object of the present invention aims at providing a new and improved construction of a power take-off gearing for a ship's drive which is constructed such that it can be rapidly installed and at low cost, especially also retrofitted at existing ship's drives or propulsion systems.

A further significant object of the present invention aims at devising a new and improved construction of power take-off gear unit which is relatively simple in design, economical to manufacture, extremely reliable in operation, not readily subject to breakdown or malfunction, requires a minimum of maintenance and servicing, and can be assembled rapidly and with modest cost requirements both at new constructions of vessels and also retrofitted at existing propulsion systems or drives of already constructed vessels.

Now in order to implement these and still further objects of the invention, which will become more readily apparent as the description proceeds, the power take-off gearing or gear unit of the present development is manifested by the features that the housing of the power take-off gearing can be supported at the foundation of the vessel or ship independent of the propeller shaft. The large gear of the power take-off gearing possesses a hollow hub which is mounted within the aforementioned housing and is connected with the propeller shaft by means of a moveable clutch. This clutch possesses a clutch sleeve which is arranged with radial play completely about the propeller shaft and partially within the hub. A clutch ring is attached at a flange of the propeller shaft. The smallest internal diameter of the clutch sleeve is larger than the external diameter of the flange, and the clutch ring is divided in an axial plane.

By virtue of this arrangement there is attained the advantageous result that it is only necessary to release a flange connection of the propeller shaft and to axially displace a part of the propeller shaft located there behind, in order to be able to push the clutch sleeve and the large gear of the power take-off gearing which surrounds the clutch sleeve over the flange of the propeller shaft, with which there should be connected the large gear with the aid of the clutch sleeve. It is unnecessary to perform structural modifications or changes at the shaft portion of the propeller shaft which is enclosed by the housing of the power take-off gearing or gear unit. The inventive power take-off gearing therefore can be readily installed, even conveniently retrofitted, at the propulsion system of vessels of ships, and generally there is not needed more than one-half day for such work. Inversely, in critical situations the power take-off gearing can also again be easily dismantled, if necessary even when the ship is at sea.

According to a preferred constructural manifestation of the inventive power take-off gearing the moveable clutch is constructed as a conventional double tooth clutch having two clutch teeth arrangements located at a respective end of the clutch sleeve. These two clutch teeth arrangements or sets of clutch teeth engage with a respective clutch teeth arrangement provided at the hub and at the clutch ring. The length of the clutch sleeve at most is equal to the length of the hub, and the clutch teeth or teeth arrangement of the hub is disposed in its plane of symmetry. Consequently, the axial assembly space needed for installation of the clutch sleeve and the large gear of the power take-off gearing is reduced to a size which corresponds to the length of the hub of the large gear.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
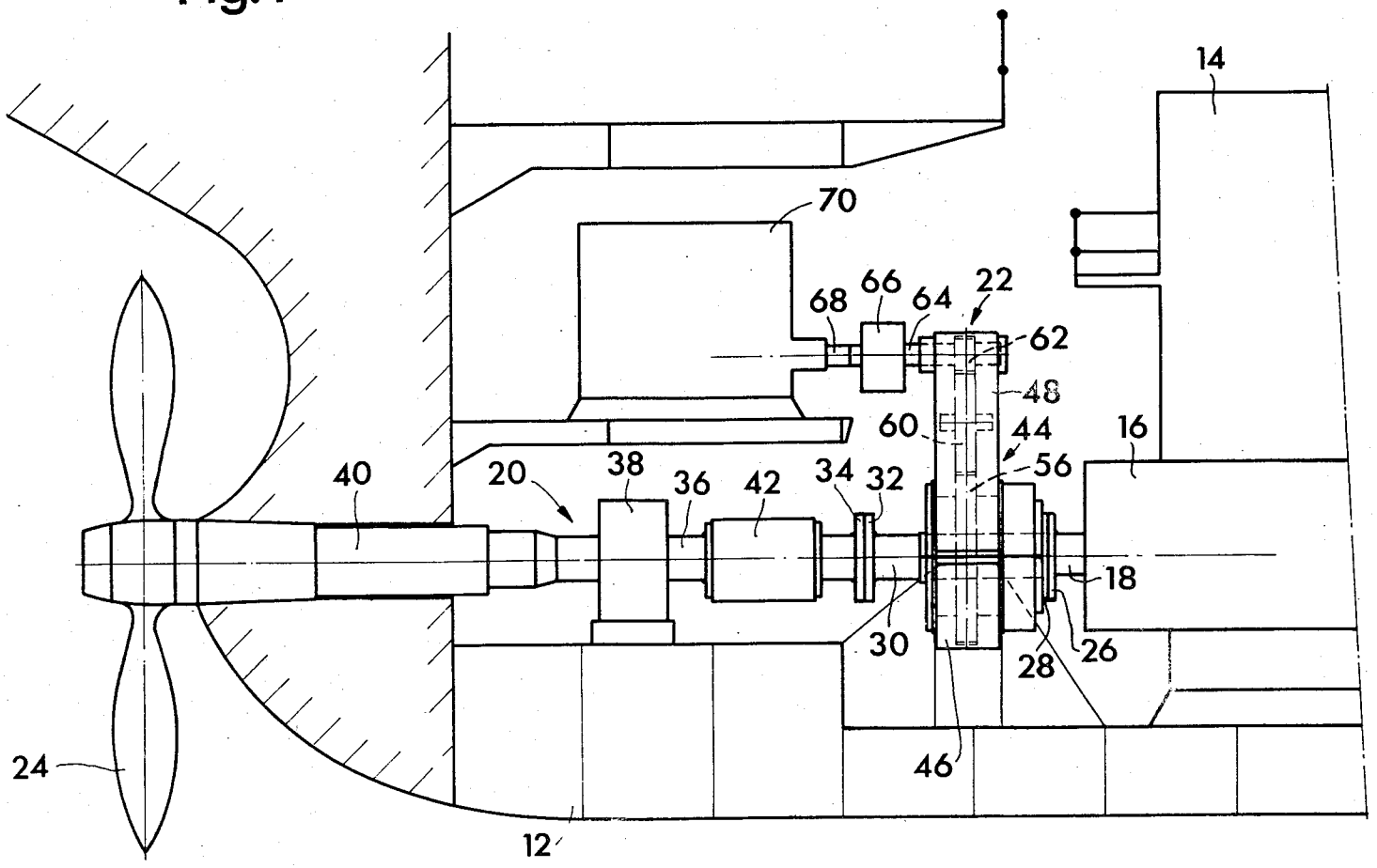
FIG. 1 is a schematic side view of a marine vessel or ship's drive or propulsion system containing a power take-off gear unit or gearing according to the invention.

Describing now the drawings, in FIG. 1 there has been illustrated an exemplary embodiment of a marine vessel or ship's drive or propulsion system which is mounted upon a ship's foundation 12 and essentially comprises a main engine 14, a speed reduction gearing 16 containing a power take-off shaft 18, a multi-part propeller shaft 20, which piercingly extends through a power take-off gearing or gear unit 22, and a propeller 24 attached to the propeller shaft 20.

The power take-off shaft 18 terminates at a flange 26 which is bolted or otherwise conveniently fastened to a front flange 28 of a first shaft portion or part 30 of the propeller shaft 20. The first shaft portion 30 terminates at a rear flange 32 which is bolted with a flange 34 of a second shaft portion or part 36 of the propeller shaft 20. The second shaft portion 36 is mounted in a thrust bearing 38 fastened at the ship's foundation 12 as well as in a further bearing 40 and carries a setting or adjustment gearing 42 for the propeller 24.

The power take-off gearing or gear unit 22 has its own housing 44 which contains a housing lower portion 46 attached to the ship's foundation 12, a housing upper portion 48 bolted or otherwise appropriately secured at the housing lower portion 46, and at the end faces there are provided the housing covers or closures 50 and 52, both of which are constructed of two parts and bolted or otherwise appropriately connected with the housing upper portion 46 and the housing lower portion 48. Arranged within the housing 44 are bearings 54 in which there is mounted a large gear or wheel 56 or equivalent structure having a relatively wide hub 58. The large gear 56 meshes with an intermediate gear 60 and the latter, in turn, meshes with a pinion 62 which is attached to a power take-off shaft 64 of the power take-off gearing 22. The power take-off shaft 64 is connected by means of a shifting coupling or clutch 66 with the shaft 68 of a generator 70 for instance.

The large gear 56 of the power take-off gearing 22 is driven by the shaft portion 30 of the propeller shaft 20 by means of a moveable clutch 72 which, in the illustrated embodiment, is constructed as a double tooth coupling or clutch. Belonging to the moveable clutch 72 is a clutch sleeve 76 which is provided at both of its ends with a respective ring of external teeth or external teeth arrangement 78 and 80. The external teeth 78, also referred as an external gear, engages with a ring of internal teeth or an internal teeth arrangement 82 which is formed at a two-part or bipartite coupling or clutch ring 84. This clutch ring 84 is attached at the front flange 28 of the shaft portion 30, and specifically with the aid of threaded bolts 86 or equivalent fastening expedients which are anyway provided, in order to interconnect the flanges 26 and 28, and thus, the shaft portions 18 and 30 of the propeller shaft 20.

Figure 2:
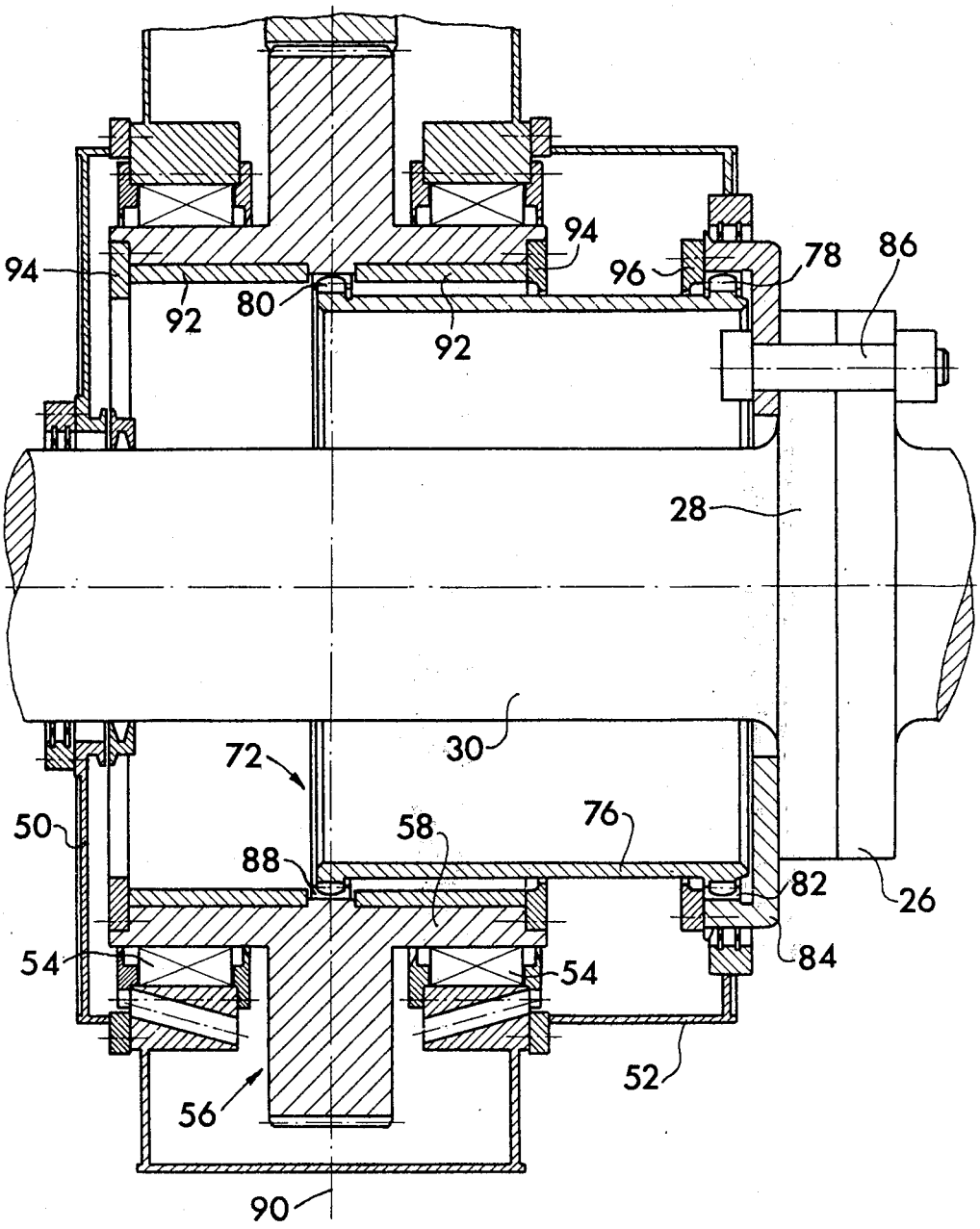
FIG. 2 is an axial fragmentary sectional view, on an enlarged scale, of the power take-off gearing of the arrangement of FIG. 1.

The external teeth or external teeth arrangement 80 of the clutch sleeve 76 engages with internal teeth or an internal teeth arrangement 88, which also may be referred to simply as an internal gear. The internal teeth arrangement 88 is formed at the center of the hub 58 of the large gear 56 which is symmetrically constructed particularly in relation to a symmetry plane 90, as will be seen by referring to FIG. 2.

At both sides or ends of the internal teeth arrangement 88 there is mounted in the hub 58 a respective sleeve or sleeve member 92 which limits the axial mobility of the coupling or clutch sleeve 76 in relation to the large gear 56. These sleeves or sleeve members 92 are fixedly retained by a respective attachment ring 94 which is bolted or threadably connected or otherwise appropriately fastened at the gear hub 58. The axial mobility of the clutch sleeve 76 in relation to the clutch ring 84 is limited by an impact or stop ring 96 which is bolted or otherwise appropriately fastened to the clutch ring or ring member 84.

The outer or external diameter of the clutch sleeve 76 is clearly smaller than that of the sleeves 92 and the attachment ring 94, which enclose the clutch sleeve 76. The internal diameter is somewhat larger than the external diameter of the flange 28, and thus appreciably larger than the external diameter of the shaft portion 30. The clutch sleeve 76 therefore allows relative movements between the propeller shaft 20 and the large gear 56 of the power take-off gearing 22. In this way there is avoided that alignment errors between the propeller shaft 20 and the large gear 56 of the power take-off gearing 22 will produce any kinds of forces which could load the propeller shaft 20 or part of the power take-off gearing 22, especially the bearings or bearing means 54. Such alignment errors can arise because of assembly inaccuracies, elastic or permanent deformations of the ship's foundation 12 or also owing to bending or flexural vibrations of the propeller shaft 20.

Since the internal diameter of the clutch or coupling sleeve 76 is larger than the external diameter of the flange 28, it is possible for the assembly or disassembly of the power take-off gearing or gear unit 22 to displace the clutch sleeve 76 along with the large gear 56 over the flange 28 of the shaft portion 30 as soon as there have been released the threaded bolts 86 or the like and the shaft portions 30 and 36 have been axially shifted apart. The length of the clutch sleeve 76 is somewhat smaller than the axial length of the hub 56. Consequently, the clutch sleeve 76 can be completely inserted into gear hub 58 after the attachment or securing rings 94 and the sleeves 92 have been dismantled. The axial intermediate space between the flanges 28 and 34, needed for the assembly and disassembly of the power take-off gearing 22, therefore is not appreciably larger than the axial length of the hub or hub member 58.

While there are shown and described present preferred embodiments of the invention, it is to be distinctly understood that the invention is not limited thereto, but may be otherwise variously embodied and practiced within the scope of the following claims. Accordingly,

What I claim is:

1. In a power take-off gearing for installation at a drive of a vessel having a foundation, wherein a propeller shaft is flanged to a power take-off shaft of a drive arrangement and a large gear of the power take-off gearing is arranged coaxially with respect to the propeller shaft and is driven by such propeller shaft, the large gear being arranged within a housing which is supported as a self-contained unit at the foundation of the vessel, the improvement which comprises:

the housing of the power take-off gearing being structured to be supported at the foundation of the vessel independent of the propeller shaft;

the large gear of the power take-off gearing possessing a hollow hub and being mounted in said housing;

a moveable clutch for connecting the hollow hub of the large gear with the propeller shaft;

said moveable clutch containing a clutch sleeve and a clutch ring;

said clutch sleeve being arranged about the propeller shaft with radial play and partially within the hollow hub;

said clutch ring being secured at a flange of the propeller shaft;

the smallest internal diameter of the clutch sleeve being larger than the external diameter of the flange of the propeller shaft; and the clutch ring being divided in a plane extending in axial direction of the clutch ring.

2. The improvement as defined in claim 1, wherein:

said moveable clutch comprises a double tooth clutch;

said double tooth clutch containing two clutch teeth arrangements, each of which is disposed at one respective end of the clutch sleeve;

said hub and said hollow clutch ring having respective clutch teeth arrangements;

said clutch teeth arrangements of the clutch sleeve respectively engaging with said clutch teeth arrangement of the hollow hub and the clutch teeth arrangement of the clutch ring;

the length of the clutch sleeve at most being equal to the length of the hollow hub; and the clutch teeth arrangement of the hollow hub being located at a plane of symmetry of the hollow hub.

3. The improvement as defined in claim 1, wherein:

said drive arrangement comprises a main engine.

4. The improvement as defined in claim 1, wherein:

said drive arrangement comprises gearing means.

5. The improvement as defined in claim 4, wherein:

said housing of the power take-off gearing is arranged in spaced relationship from said gearing means of said drive arrangement and constitutes a separate structural unit in relation to said gearing means.

6. The improvement as defined in claim 1, wherein:

said housing of the power take-off gearing is arranged in spaced relationship from said drive arrangement and constitutes a separate structural unit in relation to said drive arrangement.

* * * * *